US005095781A

United States Patent [19]

Blake et al.

[11] Patent Number: 5,095,781

[45] Date of Patent: Mar. 17, 1992

[54] RATCHET SPINNER

[75] Inventors: Jonathan D. Blake, Shrewsbury; Vincent A. Piucci, Jr., Spencer, both of Mass.

[73] Assignee: Stanley-Parker, Inc., Worcester, Mass.

[21] Appl. No.: 643,448

[22] Filed: Jan. 18, 1991

[51] Int. Cl.[5] ..... B25B 13/00

[52] U.S. Cl. ..... 81/58.1; 81/177.1; 16/114 R

[58] Field of Search ..... 81/58.1, 60–63.2, 81/177.1, 180.1, 448, 452; 16/114 R, 121

[56] References Cited

U.S. PATENT DOCUMENTS 1,305,249 6/1919 Buck ..... 81/58.1
2,462,729 2/1949 Deck ..... 81/58.1
2,612,809 10/1952 Hunt ..... 81/58.1
2,978,927 4/1961 Blanton ..... 16/121 X
3,283,621 11/1966 Faso ..... 81/58.1 X

FOREIGN PATENT DOCUMENTS 2103977 3/1983 United Kingdom ..... 81/58.1

*Primary Examiner*—James G. Smith
*Attorney, Agent, or Firm*—Samuels, Gauthier & Stevens

[57] ABSTRACT

A ratchet spinner comprises a centrally apertured disk with a serrated peripheral edge. An integral segmented collar surrounds the central disk aperture and protrudes axially therefrom. The segmented collar defines a plurality of flat sided flanges arranged tangentially with respect to the circumference of the central aperture.

7 Claims, 3 Drawing Sheets

RATCHET SPINNER

BACKGROUND OF THE INVENTION

1. Field of the Invention

This invention relates generally to box type ratchet wrenches, and is concerned in particular with a spinner adapted to be detachably coupled to the rotatable sockets of such wrenches.

2. Description of the Prior Art

Ratchet wrenches are well known to those skilled in the art. The typical ratchet wrench has an elongated handle carrying rotatable sockets at each end. The sockets have through openings which are internally configured to axially receive and rotatively engage particularly sized fasteners, e.g., nuts or bolt heads, and are externally configured as ratchet wheels forming parts of ratchet mechanisms also carried at each end of the wrench handle. The ratchet mechanisms may be adjustable to permit socket rotation in one or the other direction. Alternatively, the ratchet mechanisms may be non-adjustable, in which event only unidirectional socket rotation is permitted. Thus, with non-adjustable ratchet mechanisms, depending on how the wrench is held, a particular ratcheted socket may be employed to either tighten or loosen a fastener. More particularly, if one assumes that the wrench has "top" and "bottom" surfaces, and that with the top surface facing upwardly, the ratchet mechanism is arranged to permit rotation of the handle relative to a socket only in the counterclockwise direction, then the wrench may be employed to rotate a fastener received in that socket in a clockwise "tightening" direction. By reversing the wrench to arrange the bottom surface facing upwardly, the same socket may now be employed to rotate the fastener in a counterclockwise "loosening" direction. The same result may be obtained with adjustable ratchet mechanisms by simply shifting the pawl, without reversing wrench orientation.

Although ratchet wrenches of the above described types have enjoyed widespread commercial acceptance, particularly by mechanics in the automotive field, their efficiency has been continually compromised by several relatively minor yet persistent problems. For example, because the ratcheted sockets have through openings, there is a tendency for fasteners such as bolt heads to pass completely through the sockets. This becomes particularly bothersome when the wrenches are being employed under conditions of limited access and/or visibility.

Also, where fasteners have extended thread runs, the use of such wrenches can be tedious due to the lack of any convenient means for rapidly rotating or "spinning" the sockets in relation to the wrench handles. Spinners are known, but their use has heretofore been limited to drive tools for detachable sockets.

SUMMARY OF THE INVENTION

With the above in mind, an object of the present invention is to provide a spinner which can be detachably applied to the rotatable ratcheted socket of a wrench. When thus applied, the spinner will allow the socket to be rapidly rotated without having to manipulate the handle to and fro. In addition, the spinner will prevent passage of the fastener completely through the socket.

As will hereinafter be described in greater detail, the spinner of the present invention includes a disk dimensioned to overlie either end of the wrench socket. The disk is preferably centrally apertured to allow visibility into the socket's through opening. The disk aperture is surrounded by an axially protruding segmented collar designed to protrude into the through opening of the socket. When thus positioned in the through opening, the segmented collar serves two purposes: first, it detachably secures the spinner in rotative engagement with the socket; secondly, it serves as a plug which insures that the fastener remains captured within the socket.

Preferably, the periphery of the disk is serrated to facilitate its rapid rotation. Also, the segmented collar preferably defines a plurality of flat sided flanges arranged tangentially with respect to the central disk aperture.

These and other objects, features and advantages of the present invention will be described hereinafter in greater detail with reference to the accompanying drawings, wherein:

DETAILED DESCRIPTION OF THE INVENTION

Figure 1:
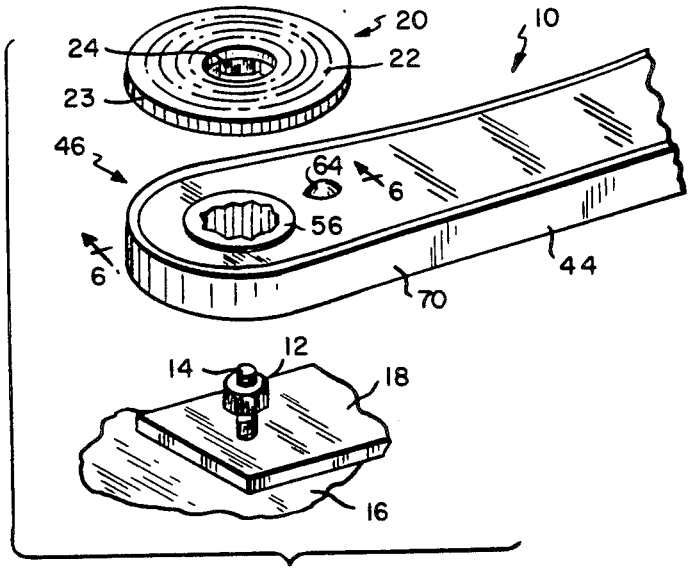
FIG. 1 is a perspective composite view of a spinner in accordance with the present invention shown removed from a one end of a typical ratchet wrench of the type having non-adjustable ratchet mechanisms, the wrench being positioned above a fastener to which the ratcheted socket is to be applied.
Figure 2:
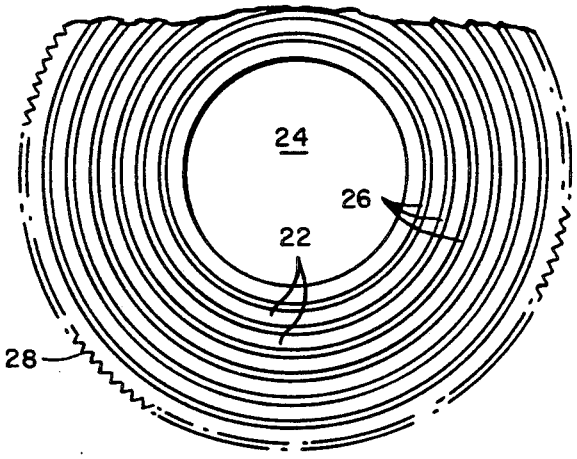
FIG. 2 is a top plan view of the spinner.
Figure 3:
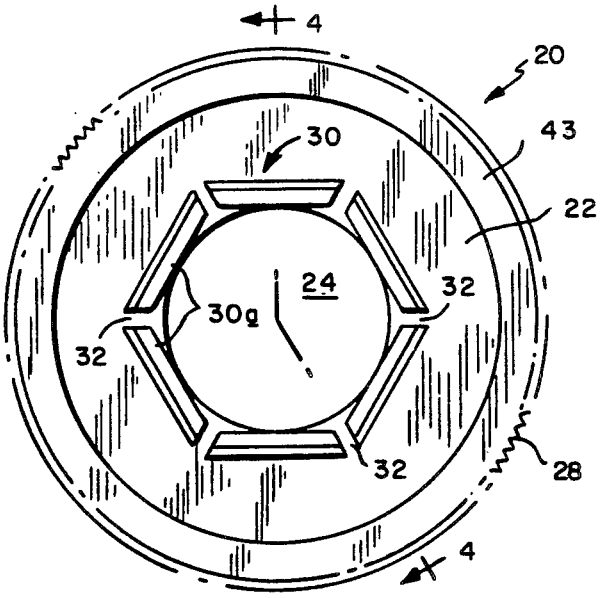
FIG. 3 is a bottom plan view of the spinner.
Figure 4:
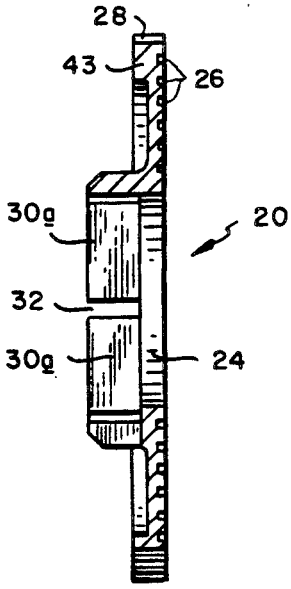
FIG. 4 is a sectional view of the spinner taken along line 4—4 of FIG. 3.
Figure 5:
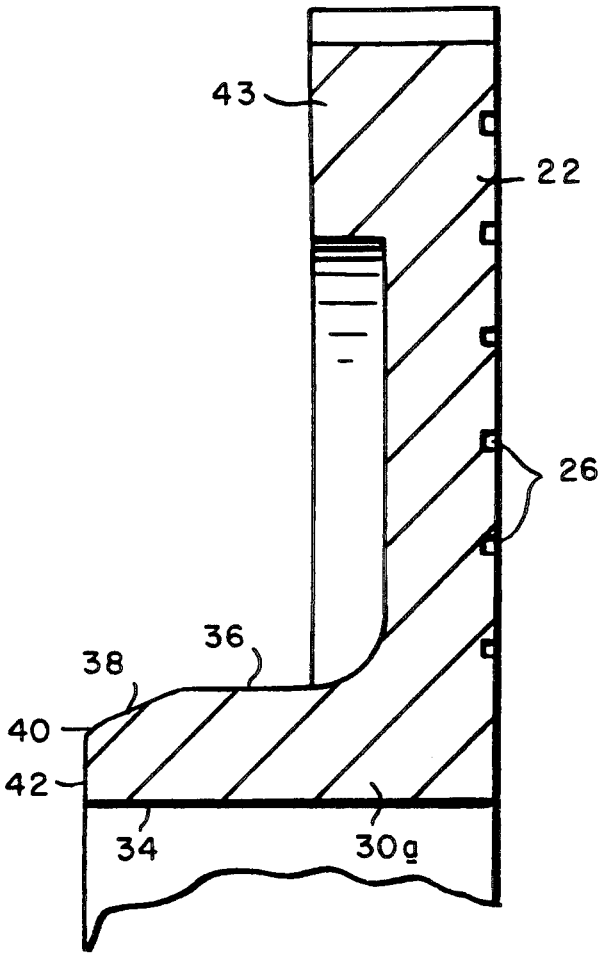
FIG. 5 is an enlarged sectional view of a portion of the spinner.

Referring now to the drawings, and with initial reference to FIG. 1, one end of a conventional ratchet wrench 10 is shown overlying a nut 12. The nut is threaded onto a stud 14 extending vertically from a base 16 through a plate 18. The nut 12 is to be tightened by rotation in a clockwise direction in order to fasten the plate 18 onto the base 16.

A spinner in accordance with the present invention is shown at 20. With reference additionally to FIGS. 2-5, it will be seen that the spinner includes a circular aperture 24 at its center. The top surface of the disk is preferably provided with a series of concentric circular grooves 26, and its peripheral edge is serrated as at 28. An integral circular collar 30 surrounds the central opening 24 and protrudes axially from the bottom surface of the disk 22.

Collar 30 is segmented by a series of radial slots 32 into a plurality of flat faced flanges 30*a*, the inner surfaces of which are disposed tangentially to the circumference of central aperture 24. As can best be seen in FIG. 5, each flange 30*a* has a flat inner face 34 parallel to the axis of central aperture 24, and a flat outer face 36 parallel to the inner face 34. The outer face 36 has a bevelled segment 38 leading to a chamfered edge 40, which in turn leads to a flat edge 42 perpendicular to both the inner and outer faces 34, 36.

The flat outer faces 36 of the flanges 30*a* define a hexagonal shape approximating but slightly larger than that of a conventional fastener, e.g., the nut 12 shown in FIG. 1. Central collar 30 is a surrounded by a circular shoulder 43.

Figure 6:
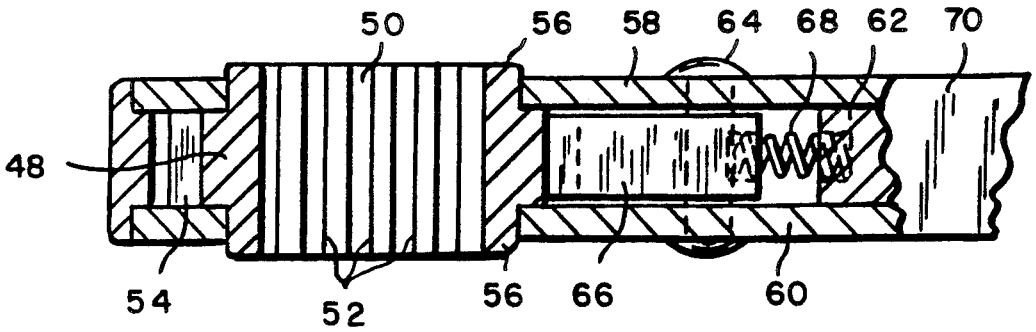
FIG. 6 is an enlarged sectional view through one end of the wrench taken along line 6—6 of FIG. 1.
Figure 7:
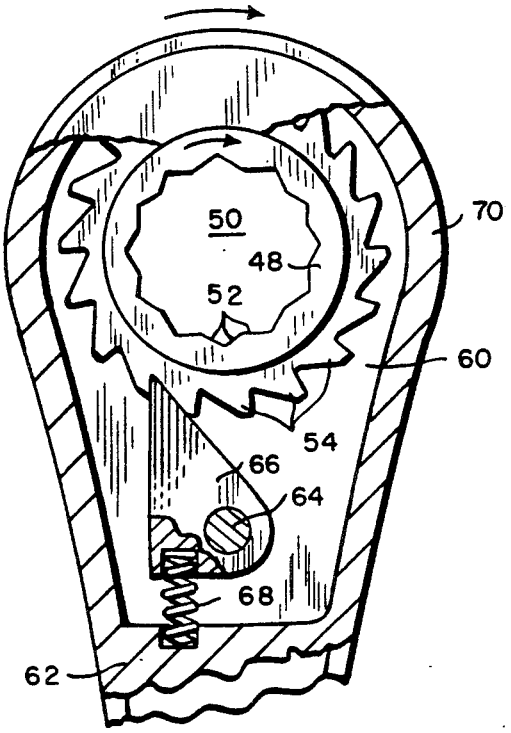
FIG. 7 is a plan view, with portions broken away, of the wrench end shown FIG. 6, the wrench being to tighten a fastener.
Figure 8:
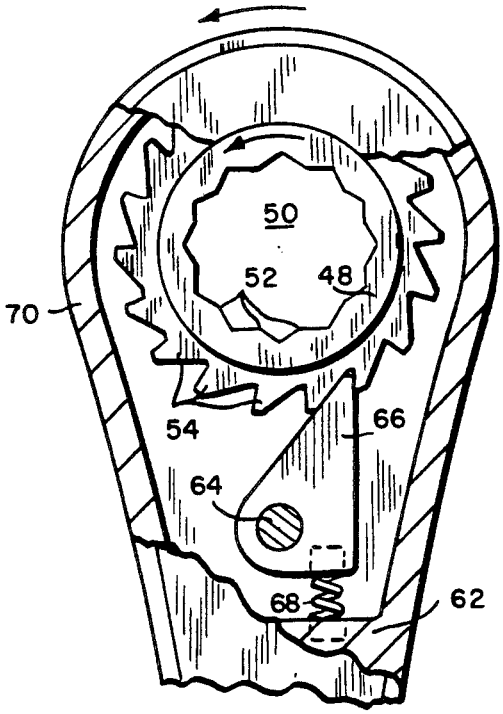
FIG. 8 is a view similar to FIG. 7 showing the wrench arranged to loosen a fastener.

As can best be seen by additional reference to FIGS. 6–8, the wrench 10 includes an elongated handle portion 44 embodying ratchet assemblies 46 at each end (only one ratchet assembly being illustrated in FIG. 1). Each ratchet assembly includes a cylindrical socket 48 having a through opening 50. The opening 50 is internally dimensioned and configured with shoulders 52 designed to rotatively engage the nut 12 or other like fastener. The socket is externally configured as a ratchet wheel with teeth 54. Cylindrical extensions 56 of the socket are rotatably received in aligned apertures in top and bottom handle plates 58, 60. The handle plates are spaced one from the other by an interior filler piece 62 and are held together by rivets 64. Each rivet 64 rotatably supports a pawl 66 urged by a spring 68 into engagement with the ratchet teeth 54 on the socket 48. The spring 68 is located in a blind bore 69 in the filler piece 62. The space between the top and bottom handle plates 58, 60 is enclosed by a strip 70 extending around the entire wrench.

With the wrench arranged as shown in FIG. 7, i.e., with the top plate 58 facing upwardly, the pawl 66 coacts with the ratchet teeth 54 to prevent clockwise rotation of the handle portion 44 relative to the socket 48, while permitting relative rotation between these two components in the opposite direction. Thus, the wrench is in a "tightening" mode. By reversing the wrench as shown in FIG. 8, i.e., with the bottom plate 60 now facing upwardly, the pawl 66 is now rearranged to prevent counterclockwise rotation of the handle portion 44 relative to the collar 48, while again permitting relative rotation between these two components in the opposite direction. The wrench is thus in the "loosening" mode.

Figure 9:
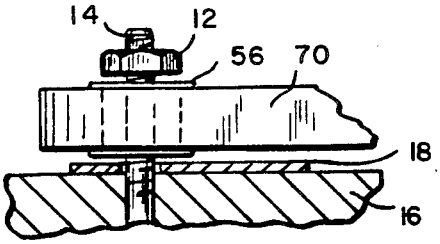
FIG. 9 is a partial elevational view of a wrench illustrating some of the problems which can be encountered without using the spinner of the present invention.

As shown in FIG. 9, one of the problems with the conventional ratchet wrench 10 is that because the sockets 48 have through openings 50, there is a tendency for fasteners such as the nut 12 to pass through, thus allowing the wrench to fall to a position below the nut where it is rendered inoperative. This is particularly troublesome under conditions where access to the fastener is limited and/or visibility is partially or totally obscured. Where the fastener must be threaded along an extended run, again as shown in FIG. 9, the process becomes tedious, involving protracted to and fro manipulation of the handle portion.

Figure 10:
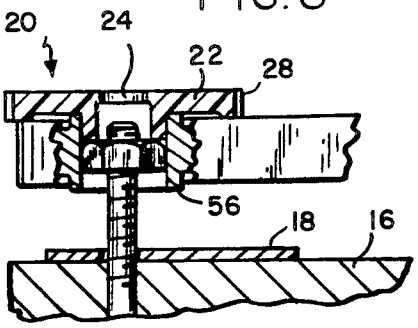
FIG. 10 is a view similar to FIG. 9 showing how the spinner of the present invention can be advantageously employed.
Figure 11:
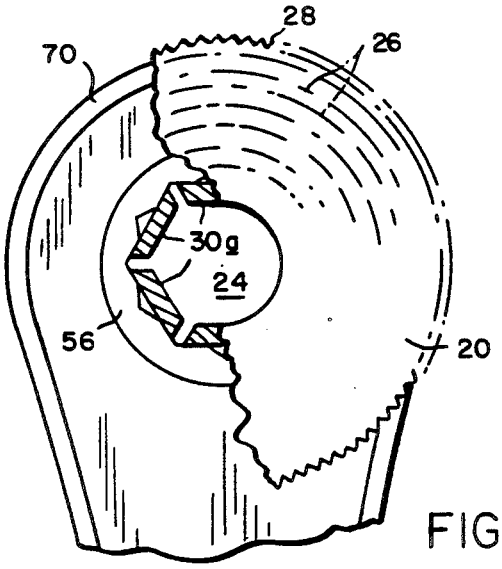
FIG. 11 is a top plan view with portions broken away of the wrench and spinner as shown in FIG. 10.
Figure 12:
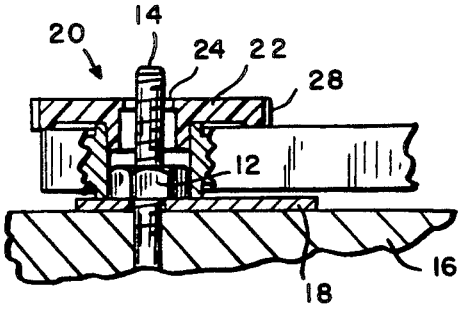
FIG. 12 is a view similar to FIG. 10 showing the relationship of the wrench and spinner to the fastener as the fastener is being tightened.

However, as shown in FIGS. 10–12, the use of a spinner in accordance with the present invention effectively obviates these problems. The spinner is detachably mounted by inserting its segmented collar 30 into the end of the through sockets opening 50 opposite to the socket end intended to receive the nut 12. Because the flat outer faces 36 of the flanges 30*a* define a hexagonal configuration slightly larger than that of the interior shoulders 52, the flanges are deflected resiliently inwardly, thereby cooperating in frictional engagement with the interior shoulders 52 to detachably secure the spinner in place while at the same time rotatively engaging the spinner to the socket 48. Axial insertion of the collar 30 into the socket opening is facilitated by the chamfered edge 40 and bevelled segment 38 on each of the flanges 30*a*. With the collar 30 thus inserted, the flat edges 42 of the flanges 30*a* provide a ledge contacting the nut 12 and preventing it from passing completely through the socket opening 50. Thus, the wrench in effect is supported on the nut 12 by means of the spinner 20. As shown in FIG. 11, the serrated periphery of the spinner extends just slightly beyond the curved periphery of the ratchet head. Thus, by simply running a finger around the curved end of the wrench, the serrated periphery 28 can be engaged and rotated, causing the collar 48 to undergo comparable rotation and enabling the nut to be rapidly threaded along the stud 14 without having to continually reciprocate the handle portion 44 to and fro. Rotation of the spinner is stabilized by the circular shoulder 43 riding on the underlying plate surface of the wrench.

With reference to FIG. 12, it will be seen that the wrench will ride along with the nut as the latter approaches its fully tightened position. Downward movement of the wrench is accommodated by the central aperture 24 in the spinner which allows the stud 14 to protrude therethrough. As the nut 12 bottoms onto the plate 18, the final tightening torque is applied by turning the handle portion 44 of the wrench.

When the wrench is employed to remove the nut 12, it is reversed as shown in FIG. 8 and the spinner 20 is repositioned at the opposite end of the socket opening 50. A loosening torque is then applied by rotating the handle portion 44. Thereafter, the spinner is again rotated by engaging its serrated periphery 28 to complete removal of the nut.

In light of the foregoing, it will be appreciated by those skilled in the art that the spinner of the present invention may be employed equally as well with socket having adjustable ratchet mechanisms.

We claim:

1. A spinner for a box type ratchet wrench of the type having a cylindrical socket rotatably carried on a handle, said socket having a through opening dimensioned to axially receive a nut to be applied to a threaded member, said through opening being internally configured to rotatively engage said nut, said socket being externally configured as a ratchet wheel arranged to coact with other associated ratchet components carried by said handle, said spinner comprising: a disk dimensioned to overlie an end of said socket opposite to the end in which said nut is to be received, said disk having an aperture communicating with said through opening and having integral means bordering said aperture and adapted to protrude into the said opposite end of said through opening, portions of said integral means being arranged to detachably fix said disk to said socket, other portions of said integral means being arranged to block passage of said nut through said opposite end, with passage of said threaded member through said disk being accommodated by said aperture.

2. The spinner of claim 1 wherein the external diameter of said disk is greater than the external diameter of said socket.

3. The spinner of claim 1 wherein said internal means comprises a segmented collar defining a plurality of resiliently flexible flanges.

4. The spinner of claim 3 wherein said flanges have flat internal and external faces, said internal faces being arranged tangentially with respect to the circumference of said central opening.

5. The spinner of claim 4 wherein said flanges are configured to engage and be resiliently deflected inwardly by said socket.

6. The spinner of claim 1 wherein the peripheral edge of said disk is serrated.

7. A ratchet spinner comprising, in combination, a disk having a central aperture and a serrated peripheral edge, and a segmented collar surrounding said central aperture and protruding axially from one face of said disk, said segmented collar defining a plurality of flat sided flanges arranged tangentially with respect to the circumference of said central aperture.

* * * * *